343-700 MS AU 256 EX
4/7/81 OR 4,260,988

United States Patent [19]

Yanagisawa et al.

[11] 4,260,988

[45] Apr. 7, 1981

[54] STRIPLINE ANTENNA FOR MICROWAVES

[75] Inventors: Wasuke Yanagisawa; Hiroshi Watanabe, both of Kamifukuoka, Japan

[73] Assignee: New Japan Radio Company Ltd., Tokyo, Japan

[21] Appl. No.: 27,105

[22] Filed: Apr. 4, 1979

Related U.S. Application Data

[63] Continuation of Ser. No. 828,997, Aug. 30, 1977, abandoned.

[30] Foreign Application Priority Data

Aug. 30, 1976 [JP] Japan ..... 51-103504

[51] Int. Cl.[3] ..... H01Q 1/38

[52] U.S. Cl. ..... 343/700 MS; 343/806

[58] Field of Search ..... 343/731, 806, 700 MS, 343/708

[56] References Cited

U.S. PATENT DOCUMENTS

| | | | |
|---|---|---|---|
| 3,811,128 | 5/1974 | Munson | 343/700 MS |
| 4,021,810 | 5/1977 | Urpo et al. | 343/731 |

OTHER PUBLICATIONS

Rotman and Karas "The Sandwich Wire Antenna" IRE National Convention Record Part I, Mar. 18-21, 1957, pp. 166-172.

*Primary Examiner*—David K. Moore
*Attorney, Agent, or Firm*—Koda and Androlia

[57] ABSTRACT

A stripline antenna for micro waves fed from one end of plural antenna arrays for easy arrangement of feeding elements, and coupled with a shielded stripline branching circuit for preventing antenna beam pattern from being disturbed by the reflected energy and for radiating the supplied energy as an effective electromagnetic wave beam.

3 Claims, 7 Drawing Figures

STRIPLINE ANTENNA FOR MICROWAVES

This is a continuation of application Ser. No. 828,997, filed Aug. 30, 1977, and now abandoned.

BACKGROUND OF THE INVENTION

1. Field of Invention

This invention relates to an antenna using stripline for microwaves.

2. Description of the Prior Art

Conventionally, a stripline antenna for micro waves is electrically fed at the center of an antenna array 1 as shown in FIG. 1. The two feeding points are indicated as 2 and 2' respectively, and the spacing between the points 2 and 2' is limited depending on the wave length of radiating electromagnetic wave. The usual spacing between the feeding points 2 and 2' is selected from a few millimeters to more than ten millimeters in the microwave band, and it is difficult to arrange the feeding elements at the same level with the stripline antenna for micro waves. Accordingly in a conventional antenna system it is an usual method that a coaxial feeder or a wave guide is stereoscopically arranged in the backward space of the antenna to feed the antenna in-phase. This method, however, has structural difficulties since the higher frequency requires a narrow spacing between feeding points 2 and 2' as well as a larger cubic volume of feeding section. Furthermore, the prior art stripline antenna for micro waves has another drawback, which arises more difficult problems, in feeding of plural antenna arrays.

SUMMARY OF THE INVENTION

Accordingly, it is the general object of the present invention to provide a stripline antenna for micro waves system in which the afore-mentioned drawbacks are obviated.

In keeping with the principles of the present invention, the object is accomplished with a unique stripline antenna for micro waves coupled to a shielded stripline branching circuit which is connected to one end of the antenna array.

BRIEF DESCRIPTION OF THE DRAWING

The above mentioned and other features and the object of the present invention will become more apparent by reference to the following description taken in conjunction with the accompanying drawings, wherein like referenced numerals denote like elements, and in which.

DETAILED DESCRIPTION OF THE INVENTION

Figure 2:
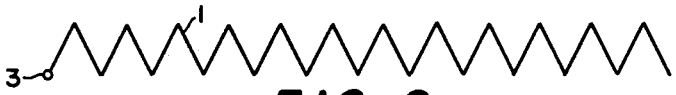
FIG. 2 shows a feeding system in accordance with the teachings of the present invention.

Referring more particularly to the drawings, shown in FIG. 2 is an embodiment of the feeding point of the antenna array in accordance with the teachings of the present invention. The feeding point is denoted by 3.

Figure 3:
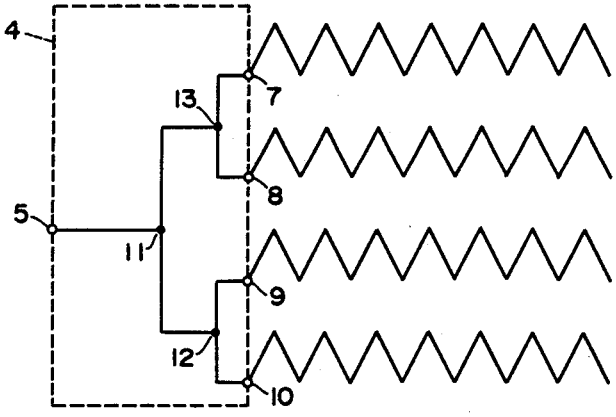
FIG. 3 shows a preferred embodiment in accordance with the teachings of the present invention.

Shown in FIG. 3 is another embodiment using four arrays in accordance with the teachings of the present invention, wherein the numeral 4 indicates a shielded branching circuit composed of Tri-Plate stripline, etc., numeral 5 shows an input terminal, numerals 7, 8, 9 and 10 are the feeding points to antenna arrays, and numerals 11, 12 and 13 are denote branch points.

Figure 1:
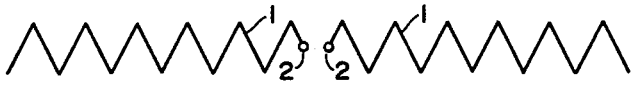
FIG. 1 shows a feeding system used heretofore.

In operation, a signal is supplied to the feeding terminal 5 from a coaxial feeder by way of a matching circuit, and is fed to each array at the respective feeding points 7, 8, 9 and 10 after being divided into two equal signals at the branch points 11, 12 and 13. In this connection, each array is excited in-phase when the electrical distance from the feeding terminal 5 to the respective feeding points 7, 8, 9 and 10 is equal. If the branching circuit 4 were on non-shielded type stripline, it might possibly disturb the antenna beam pattern due to the radiant energy derived from the large current flow in the branching filter 4. Accordingly, the branching circuit 4 is shielded. This part forms a tri-plate stripline type structure. The shielded tri-plate stripline branching circuit in this invention is very effective to restrain the production of such radiant energy. In particular the shielded tri-plate strip-line type branching circuit 4 prevent electromagnetic radiation from being directly radiated from the lines of the feed branching circuit 4; i.e., the line from point 5 to 11, 11 to 12, 11 to 13, 13 to 7, 13 to 8, 12 to 9 and 12 to 10. Referring to FIG. 1, it is easily presumed that the feeding power is symmetrically attenuated since the feeding points are located in the center. In the present invention it is necessary to examine the symmetrization since a signal is supplied to one end of antenna array. On this point, the signal is propagated from one end to another with the least attentuation due to the large ratio between free space impedance and radiation impedance of stripline for microwaves which consists of each array.

Figure 4A:
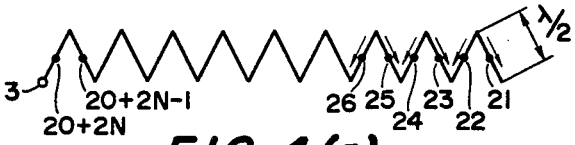
FIG. 4*a* and 4*b* show a current distribution on the antenna array.
Figure 4B:
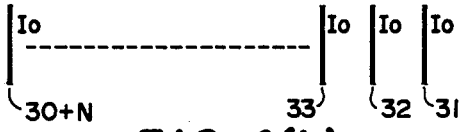

FIG. 4 shows a current distribution on each antenna array of stripline antenna in accordance with the teachings of the present invention. Described in FIG. 4 (*a*) are both the structure of each antenna array as shown in FIG. 2 and the high frequency current which flows on the array. When each one of the stripline is folded in a zig zag shape wherein each side of the zig zag is of a length $\lambda/2$, $\lambda$ being the wave length of the high frequency to be used, as shown in FIG. 4 (*a*), for example, standing waves arise due to the open end on the other side. In the present case where the signal is supplied from the feeding point 3, the peak current flows at points 21, 22, 23 . . . (20+2N) in FIG. 4 (*a*), that is, at each point at $\frac{1}{4}\lambda$, $\frac{3}{4}\lambda$, $5/4\lambda$ from the open end along the line. The direction of the current at the respective points at a certain moment is as shown by arrow. Accordingly, the synthesis of current at the points 21 and 22 makes vertically directed current vector Io as shown at 31 in FIG. 4 (*b*) since mutual cancellation of right and left directed component leaves a vertically directed component. The synthesis of current at the points 23 and 24 in FIG. 4 (*a*), also makes a current vector 32 in FIG. 4 (*b*), and the same rule applys to the description of current vector up to 30+N in FIG. 4 (*b*).

As described in the above, one such antenna array is equivalent to one consisting of N pieces of dipole of equal current value Io in parallel with each other and at regular intervals as shown in FIG. 4 (*b*), when regarded as a radiant source. Furthermore, the standing wave on each antenna array means that almost all the incident wave energy is reflected from the feeding points to the feeding section. However, a placement of an adequate matching circuit before the branching circuit 4 on the feeding section as described in FIG. 3, it is easy to match the whole system in addition to cancellation of the reflection from the afore-described branching points 11, 12 and 13, and makes it effective to radiate supplied energy for an electromagnetic wave beam.

Figure 5:
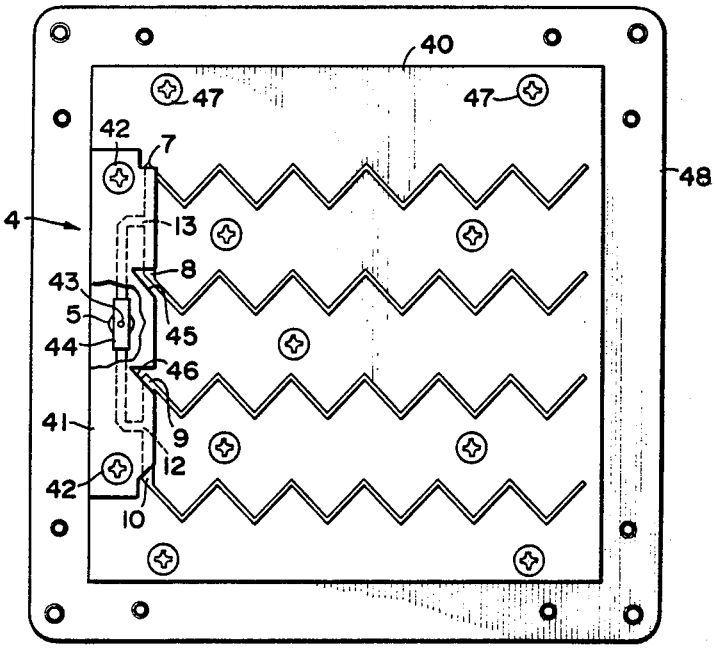
FIG. 5 is a top view showing a preferred embodiment of stripline antenna for micro waves system in accordance with the teachings of the present invention.
Figure 6:
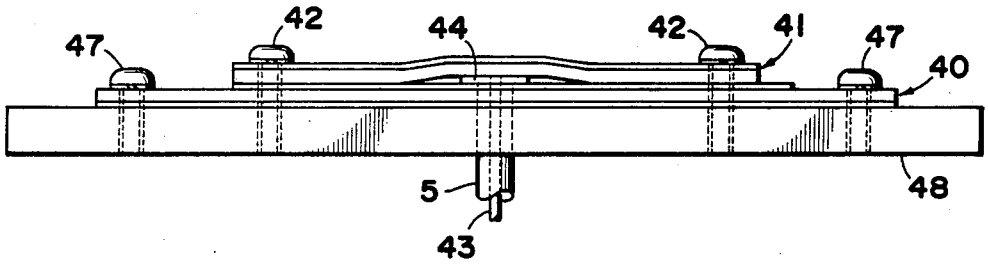
FIG. 6 is a side view of the micro-stripline antenna system of FIG. 5.

Shown in FIG. 5 is a physical construction of a strip-line antenna for microwaves in accordance with the teachings of the present invention. There are shaped four antenna arrays shown in FIG. 3, which are etched in copper foil provided on the surface of teflon-glass laminated substrate 40, the other side of which is also provided with copper foil. The stripline connecting the feeding points 7, 8, 9 and 10 of each antenna array, and the stripline connecting each of branch points 12 and 13 to the input terminal 5 are also obtained by etching the copper foil provided on the surface of substrate 40 in the same way as antenna arrays. On the surface part of the branching circuit 4 of substrate 40 is held an antenna mask 41 in place by means of two bolts 42. The antenna mask 41 is also composed of teflon-glass laminated substrate same as the substrate 40, one surface of which is provided with copper foil.

As described in the above, the part of the branching circuit 4 forms the tri-plate type strip-line structure which consists of the strip-line conductor attached onto the surface of the substrate 40, a metal conductor attached on the other surface of the substrate 40 and another metal conductor on the antenna mask 41.

The input terminal 5 has a hole penetrating through the substrate 40 and this through hole is arranged with a lead wire 43, the end of which is connected to a wave guide, not shown in the Figure. The other end of lead wire 43 is connected to copper tape 44 which is coupled to the stripline. In the closest part of antenna mask 41 to the feeding points 8 and 9 sawtoothed cuttings 45 and 46 are made so that the signal supplied to each antenna array can be arranged to be in-phase.

The antenna having the afore-mentioned composition is held in place on the aluminum board 48 by means of plural bolts.

According to the precedings, the present invention provides a stripline antenna which is equipped with a simplified and small-sized feeding section by means of coupling a shielded stripline branching circuit and plural stripline antenna elements which are fed from one end.

In all cases it is understood that the above described embodiments are merely illustrative of but a few of the many possible specific embodiments which present the application of the principles of the present invention. Numerous and varied other arrangements can be readily devised in accordance with these principles by those skilled in the art without departing from the spirit and scope of the invention.

We claim:

1. A strip-line antenna for microwaves wherein:

one or more strip-line of zig-zag type for microwaves are attached onto one surface of a first dielectric plate;

a metal conductor is attached to the other surface of the first dielectric plate;

respected input ends of said antennas of zig-zag type are connected to output terminals of a strip-line branching circuit of a shielded construction, said strip-line branching circuit of shielded construction is arranged such that a second dielectric plate, onto which another metal conductor is attached, is attached onto an unshielded strip-line branching circuit attached onto said one surface of said first dielectric plate; and input terminals of said strip-line branching circuit of shielded construction are connected to a central conductor of a coaxial feeding cable.

2. A strip line antenna for microwaves as set forth in claim 1, wherein respective sections of the zigzag lines are of ½ wavelength in length and the respective strip lines are in parallel and in identical zigzag manner with one another.

3. A strip line antenna for microwaves as set forth in claim 1, wherein one or more zigzag type antennas emit or receive electromagnetic waves along a full length of said zigzag type antennas.

* * * * *